US005300861A

United States Patent [19]

Helgesen et al.

[11] Patent Number: 5,300,861

[45] Date of Patent: Apr. 5, 1994

[54] METHOD IN A PULSED ACCELERATOR FOR ACCELERATING A MAGNETIZED ROTATING PLASMA

[76] Inventors: Herman Helgesen, Kuhlgränd 2, Lund, S-222 49; Sonja R. Helgesen, Kuhlgranden 2, 222, 49 Lund, both of Sweden; Alfred Sillesen, Strandparken 14, Himmeley 4000, Roskilde, Denmark; Jan Bergström, Idrottsvägen 8, Sollentuna S-191 70, Sweden; Vladimir M. Kouznetsov, Nepokorennych 16/1-519°, Leningrad 195220, U.S.S.R.

[21] Appl. No.: 32,721

[22] Filed: Mar. 16, 1993

Related U.S. Application Data

[63] Continuation of Ser. No. 634,863, Jan. 2, 1991, abandoned.

[30] Foreign Application Priority Data

May 5, 1988 [SE] Sweden ..... 8801705-8

[51] Int. Cl.[5] ..... H01J 7/24

[52] U.S. Cl. ..... 315/111.41; 60/202; 315/111.61

[58] Field of Search ..... 328/237, 238, 233, 227; 376/126, 128, 139, 140, 144, 141, 150; 315/111.21, 111.41, 111.61; 60/202

[56] References Cited

U.S. PATENT DOCUMENTS 2,992,345 7/1961 Hansen ..... 376/128
3,318,094 5/1967 Koller ..... 60/202
3,441,798 4/1969 Veron ..... 315/111.21
3,585,441 6/1971 LaRocca ..... 60/202

FOREIGN PATENT DOCUMENTS 600941 11/1976 U.S.S.R. .
307742 7/1982 U.S.S.R. .
1140641A 10/1986 U.S.S.R. .

*Primary Examiner*—Robert J. Pascal
*Assistant Examiner*—Michael B. Shingleton
*Attorney, Agent, or Firm*—Merchant, Gould, Smith, Edell, Welter & Schmidt

[57] ABSTRACT

The invention provides in an accelerator for accelerating a magnetized rotating plasma comprising a magnetic system arrange symmetrically around an axis, two electrodes (10, 11) extending symmetrically along said axis inside the magnetic system, said electrodes being spaced from each other in the transverse direction of said axis, two pulsed power sources connected to the magnetic system and the electrodes, respectively, and openings (18) in the inner electrode in a cross-section perpendicular to said axis for the supply of a neutral gas to the space defined by said electrodes, a method for controlling the operation of the accelerator wherein the magnetic field is confined to form a layer which comprises a first cylindrical portion (12) with a minor diameter and a second cylindrical portion (14) with a major diameter and a transition portion (13) interconnecting said first and second cylindrical portions being arranged axis-symmetrically around a common axis.

5 Claims, 4 Drawing Sheets

METHOD IN A PULSED ACCELERATOR FOR ACCELERATING A MAGNETIZED ROTATING PLASMA

This is a continuation, of application Ser. No. 07/634,863, filed Jan. 2, 1991, which was abandoned upon the filing hereof.

This invention relates to a a pulsed accelerator system for accelerating a magnetized rotating plasma. This type of accelerator represents a new class of super-powerful plasma accelerators which can be called centrifugal plasma accelerators or accelerators with magnetized plasma.

The history of experiments with rotating plasma could be presented as a chain of numerous attempts to exceed the Alfvén critical velocity. In the literature several successful attempts are described.

The purpose of the present invention is to reach a speed of the plasma in a pulsed accelerator, which speed is higher than the Alfvén limit, by using the forces which arise because of rotation of the plasma, for the acceleration along the axis of the accelerator, and thus to generate a plasma at a substantially increased energy level, which is useful in applications such as plasma physics, mass and charge separation, fusion by beams and direct fission in unstable nuclei bombarded by beams, space research, and modification of surface properties of different materials by ion implantation.

The pulsed accelerator in which the method of the invention is applied comprises a magnetic system arranged symmetrically around an axis, two electrodes extending symmetrically along said axis inside the magnetic system, said electrodes being spaced from each other in the transverse direction of said axis, two pulsed power sources connected to the magnetic system and the electrodes, respectively, and openings in the inner electrode in a cross section perpendicular to said axis for the supply of a neutral gas to the space defined by said electrodes, and for said purpose the system of the invention has obtained the characteristics appearing from claim 1.

The invention and the theoretical background thereof will be described below with reference to the accompanying drawings, in which FIG. 1 is a diagrammatic view showing an axisymmetric conical magnetic layer in which a rotating plasma is located;

Figure 1:
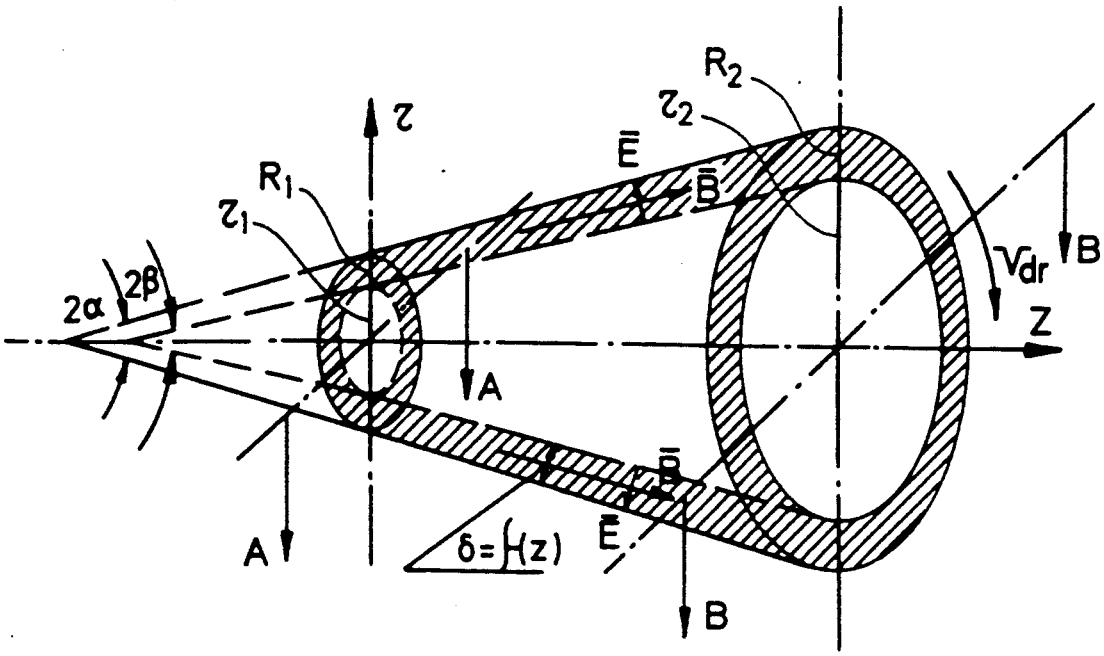

In order to explain the acceleration of a rotating plasma in a gradient magnetic field reference is made to FIG. 1 wherein there is shown an axisymmetric magnetic layer in which a rotating plasma is located, said layer being limited by cross sections A—A and B—B, respectively, at the ends thereof along the axis z. In FIG. 1

$r_1$ and $r_2$ are the inner radius of the magnetic layer in cross sections A—A and B—B, respectively, $R_1$ and $R_2$ are the outer radius of the magnetic layer in cross sections A—A and B—B, respectively, $\delta = f(z)$ is the distance between the conical surfaces limiting the magnetic layer, $2\alpha$ and $2\beta$ are the angles of the conical opening, $\overline{E}$ and $\overline{B}$ are the vectors of the electrical and magnetic field, respectively, and $v_{dr}$ is the vector of the rotational velocity of the plasma.

Assuming that a. the electric field E and the magnetic field B are constant in cross sections A—A and B—B, b. $\rho_i(z) << \delta(z)$ and $\omega >> \nu_{ei}$, wherein $\rho_i$ is the Larmor radius of ions and $\omega_i$ is the ion cyclotron frequency and $\nu_{ei}$ is the frequency of electron-ion collision.

c. $kT_i << W_{dr}$, wherein k is the Bolzmann constant, $T_i$ is the ion temperature and $W_{dr}$ is the energy of plasma rotation.

d. $\alpha = \beta$.

The motion of a rotating plasma along the magnetic field lines is determined by several forces. The main contribution to the acceleration under these conditions comes from:

1. Centrifugal inertial force $\overline{F}_c$ which arises during plasma rotation.
2. The force $\overline{F}_{\nabla w}$ which arises from the interaction between the magnetic moment of cyclotron orbits and the gradient magnetic field.
3. The force $\overline{F}_{\nabla j\rho}$ which arises from interaction of magnetic moment of drift current $j\rho$ in a gradient magnetic field.

The drift current $j\rho$ is a consequence of secondary effect due to difference in the drift velocities of electrons and ions. In this first calculation it is assumed that the forces due to gradients of plasma density, temperature or Larmor rotational velocity can be neglected.

In the case which is shown in FIG. 1 a linear relationship for magnetic field changes exists, e.g. $\nabla B = -(\beta B/\delta z)_{\hat{\rho}z}$ and $^{\delta Br}/_{\delta r}{}^{v}{}^{Br}/_{r}$.

It is also assumed that $V_{dri}\, v_{dre} = E/B$.

In this case the projection of the forces, which are taken into account, on the direction of the magnetic field are equal to each other, e.g.

$$|\overline{F}_c|_t = |\overline{F}_{\nabla w}|_t = |\overline{F}_{\nabla j\rho}| = {}^{2Wdr}/_{r} Sin\ \alpha$$

wherein the index t notifies projection of forces on the magnetic field lines.

Figure 2:
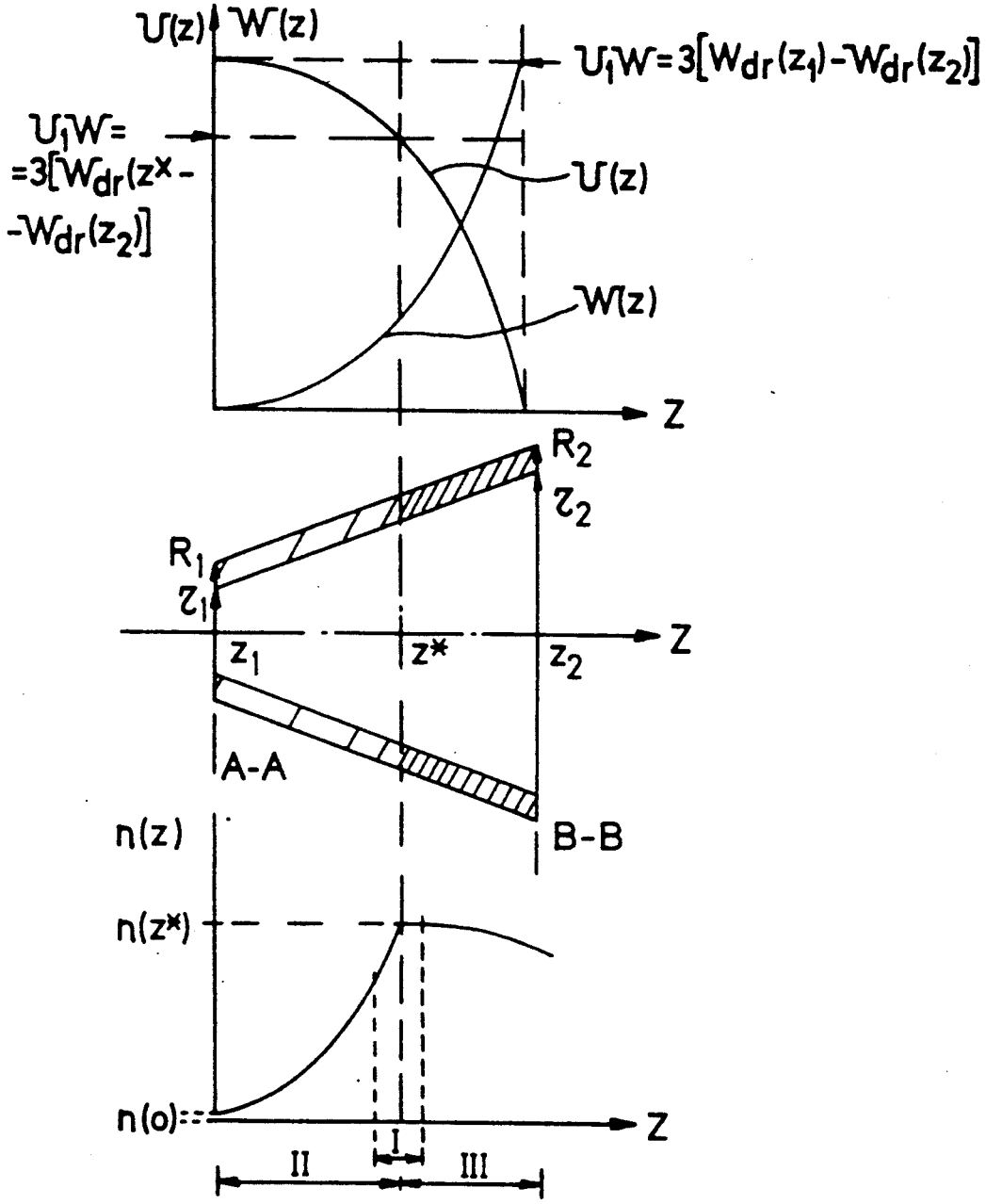
FIG. 2 is a diagram showing the potential barrier provided by tangential components of forces determining the motion of a rotating plasma.

Since electrons and ions are magnetized the normal components of the forces are balanced by the magnetic field, motion of plasma being allowed only along the field lines. Tangential components of these forces provide a potential barrier which is shown in FIG. 2 wherein U(z), W(z) are the potential and kinetic energy, respectively, of plasma distribution along the axis z, z* is the position of neutral gas injection, n(z) is the plasma density distribution in the cone, I is the ionisation region, II is the reflection region, III is the acceleration region, n(o) is the plasma density at the beginning of the cone, $z_1 = r_1 tg\alpha$ corresponds to cross section A—A and, $z_2 = r_2 tg\alpha$ corresponds to cross section B—B.

Energies of particles in cross section B—B in the total layer will be distributed in the interval $\Delta W$:

$$3\{[W_{dr}(r_1) - W_{dr}(r_2)] \div [W_{dr}(R_1) - W_{dr}(R_2)]\}$$

Analysing plasma motion in this magnetic layer and assuming that a plasma with the temperature $kT_i << W_{dr}$ is created in the cross section $z^*$ then the particle after having passed the barrier in cross section B—B ($z = z_2$) will have the energy $$W_{||} = 3[W_{dr}(r_2) - W_{dr}(Z^* tg\alpha)]$$

(see FIG. 2). If particles due to thermal motion thereof will be moving upwards against the barrier and to the top of the cone, they will lose their kinetic energy and the main part thereof will be stopped. Only particles with energy exceeding $$W^* = [W_{dr}(Z^* tg\alpha) - W_{dr}(r_1)] \cdot 3$$

will be able to reach cross section A—A.

Figure 3:
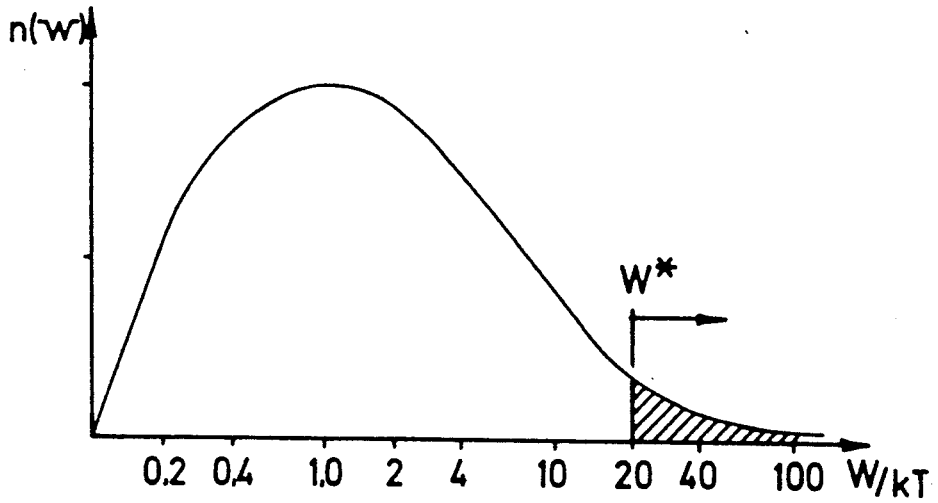
FIG. 3 is a distributing diagram showing the number of particles which can escape from a specific cross section of the magnetic layer.

FIG. 3 shows the Bolzman-Maxellian distribution of $$n(W) = \frac{2W}{(kT)3/2} \exp.$$

indicated along the vertical axis, W being the energy of particles and T being the plasma temperature.

The shadowed energy tail in FIG. 3 shows the number of particles which can escape from cross section A—A. The relative proportion of particles $\xi$ which escape from the potential barrier is less than $$\xi \approx \frac{\int_{W^{dr}}^{\infty} \sqrt{W} \exp - W/kT}{\int_{0}^{\infty} \sqrt{W} \exp - W/kT} < \exp - \frac{3W_{dr}}{kT}$$

In other words, the motion of rotating plasma in a conical magnetic layer has two main features:

1. Plasma is accelerated in the direction from the top of the cone and will finally reach a speed of motion along the axis, which depends only on the speed of plasma rotation.
2. The top of the cone between cross section A—A and the region of creation of the plasma, here called the reflector region or the magnetic mirror, cfr. FIG. 2, is protected from low energy particles.

Since the mirror field is not used for plasma confinement but only for acceleration of the plasma away from the reflector, the following condition could be satisfied:

$$W_{dr}(Z^* tg\alpha) >> kT$$

This makes it possible to keep a very low plasma density behind cross section A—A and to avoid internal shortcircuiting of the electrical field.

Figure 4:
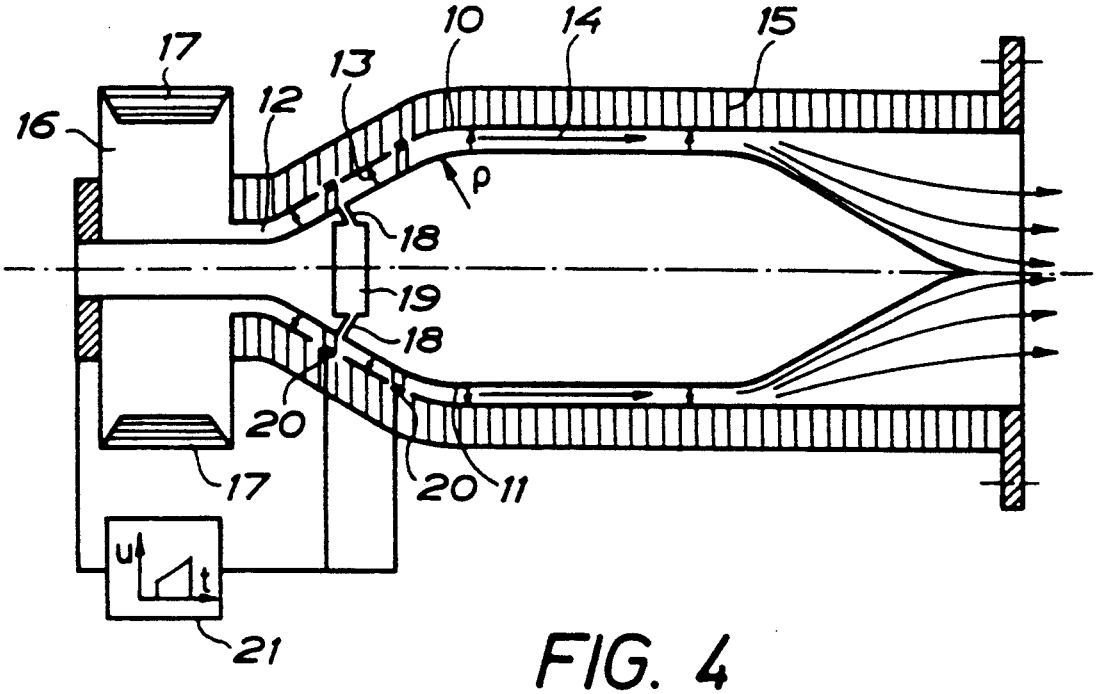
FIG. 4 is a diagrammatic axial cross sectional view of a magnetic accelerator system of the single step type operated in accordance with the invention.

The pulsed accelerator of FIG. 4 is a single step accelerator providing a rotating plasma according to the principles described with reference to FIGS. 1-3. This accelerator comprises two coaxial electrodes, an outer electrode 10 and an inner electrode 11 which extend symmetrically along a common axis spaced from each other to form a dielectric vacuum chamber which includes from the left to the right a circular cylindrical portion 12, a conical transition portion 13 flaring from portion 12, and a circular cylindrical portion 14 having a larger diameter than portion 12. Said latter portion also has a greater length than portion 12 and is termed collector. At the right end the outer electrode extends beyond the inner electrode which converges to a pointed tip so that the outlet opening of the accelerator at the right end thereof includes the full area defined by the outer electrode. The electrodes are surrounded by a magnetic system including a coil 15 or a number of such coils arranged symmetrically around the axis of the electrodes and following the shape thereof. The dielectric vacuum chamber formed between the electrodes is connected to a differential pumping system 16 having vacuum pumps 17. In a cross section perpendicular to the axis of the accelerator a set of openings 18 are provided in the inner electrode 11 in the transition portion thereof, which are connected to an injector 19 for neutral gas. The coil or coils are connected to a pulsed power source (not shown). Cathode rings 20 are provided in the outer electrode for $\bar{E} \times \bar{B}$ discharge and are connected to one terminal of a pulsed discharge power source 21, the other terminal being connected to the inner electrode forming the anode.

In the operation of the accelerator shown in FIG. 4 the magnetic coil system 15 creates a pulsed axisymmetric magnetic field which is high enough to satisfy condition (b) above. The risetime and the pulselength are long enough to impose a distributed induced current in the anode body to stop practically all field penetration.

The vacuum chamber has to satisfy three main requirements:

1. provide good vacuum conditions;
2. be penetratable to magnetic field; and
3. allow electrical field perpendicular to B-field during ionization and acceleration period.

All three requirements can be satisfied by a dielectric chamber with a set of transversely slotted cathode rings 20 or by a metallic chamber with a slot along the envelope.

In this case the pulsed magnetic flux is concentrated between the vacuum chamber and the inner electrode 11. In order to increase the time of induced current the inner electrode can be cooled by liquid nitrogen or be provided with built in magnetic coils. The current ratio between inner and outer magnetic currents can be chosen to place the separatrix on the inner electrode surface.

Neutral gas which is injected in the accelerating layer from injector 19 through openings 18 is either ionized by $\bar{E} \times \bar{B}$ discharge and accelerated to the collector 14 or pumped out as neutral gas by the pumps 17.

The plasma leaving the accelerating region 13 moves into the collector 14, which is a cylindrical magnetic layer. The length of the collector must be long enough to allow the whole plasma body to move into this region and also to allow the electrical field to be switched off and to stop the plasma rotation in the collector. This means that the mirror effect due to rotation in the accelerator output can be avoided.

In order to permit the plasma to leave the accelerator during the plasma acceleration time, the voltage between the electrodes can be increased, which leads to a higher acceleration of the last parts of the plasma body. By this method the density of the plasma in the outlet of the accelerator can be compressed. This also means a way of increasing the $\beta$-value.

It should be mentioned, that in some applications there is no need to move the plasma out of the magnetic field. In this case there is no such limitation at all.

In order to compensate for the axially unsymmetric magnetic forces, acting on the inner electrode 11, the magnetic system 15 of the accelerator has to be made longer than the inner electrode (see FIG. 4).

By building an accelerator as described with reference to FIG. 4 and comprising a certain number of steps an ultra-powerful accelerator can be provided the selected energy layer being used in combination with the compressing effect of the forming electrical fields in the different steps.

The advantage in using several simple "units" with low concentration of energy is unique, and it is also possible to build an accelerator with any type of plasma and energy levels. Previous accelerators have always been built as a single unit.

Figure 5:
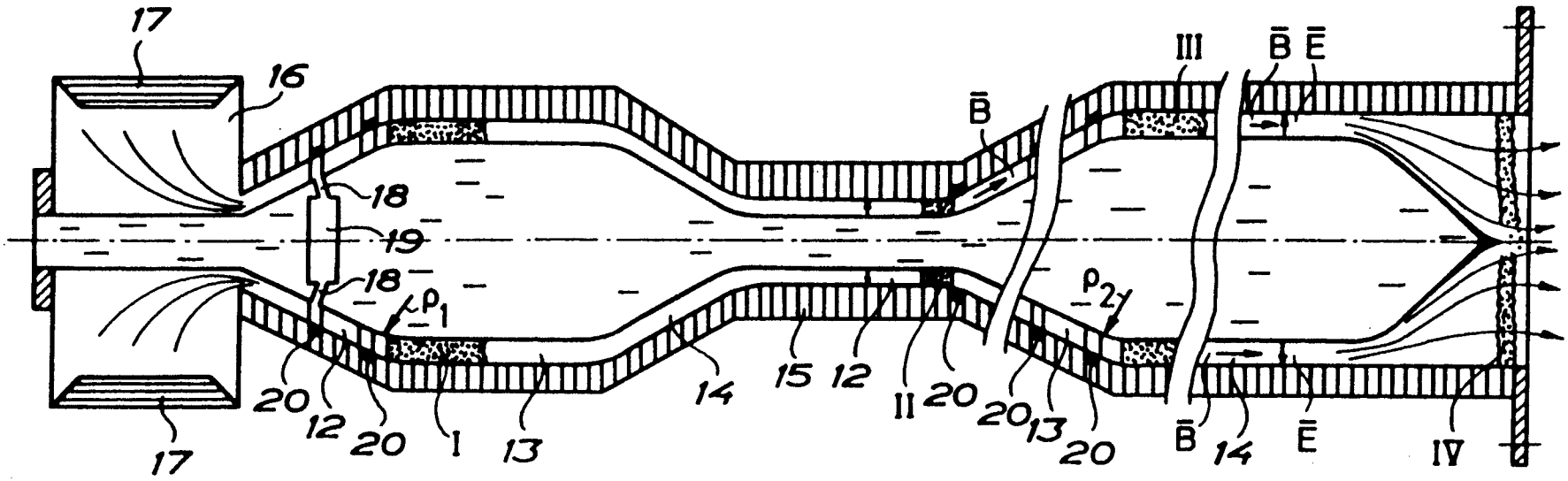
FIG. 5 is a diagrammatic axial cross sectional view of a magnetic accelerator system of the multiple step type operated in accordance with the invention.

A diagrammatic axial cross sectional view of a two step accelerator is shown in FIG. 5. With reference to the diagram in FIG. 6 it is assumed that the neutral gas injector starts at time $t_1$ and is open until time $t_2$. The voltage between the electrodes 10 and 11 is applied at time $t_2$ and shortcircuited at time $t_3$. The voltage pulse length must be long enough to allow ionization and acceleration.

Figure 6:
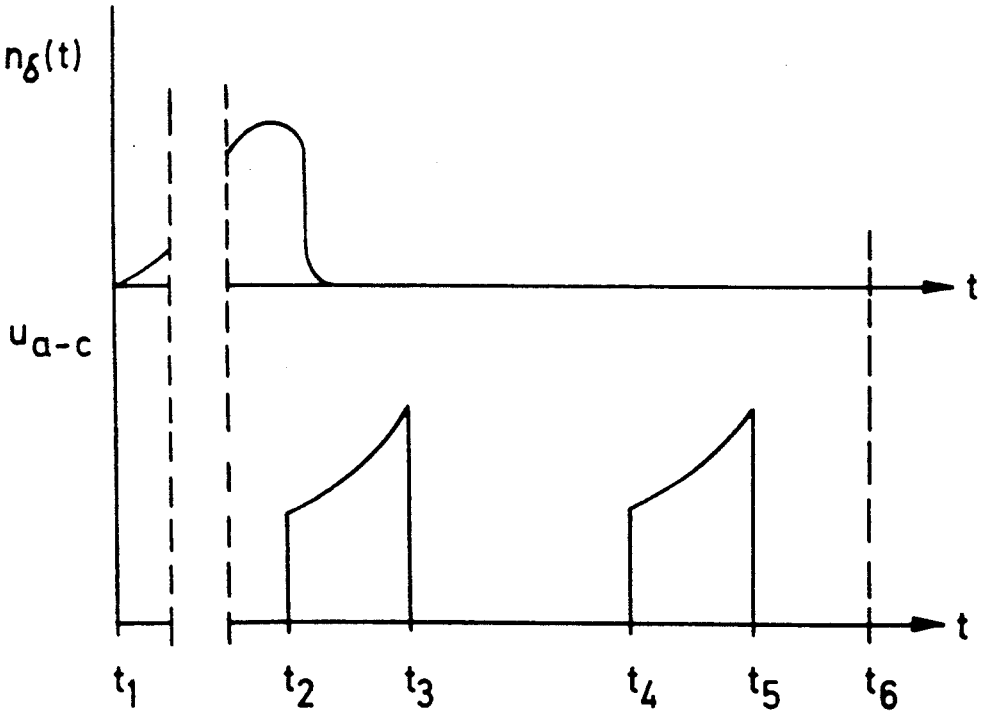
FIG. 6 is a diagram showing the density of neutrals and voltage over the discharge gap over the time.

The plasma position I in FIG. 5 is shown at time $t_3$. The plasma length is 1. The rotation of the plasma is stopped due to shortcircuiting of the driving voltage, but the plasma will move along the guiding fieldlines due to inertia. The growing pulse form of the voltage as shown in FIG. 6 is necessary in order to compress the plasma in a several step accelerator. E.g. if the plasma length at time $t_3$ is 1 and the total length from the beginning of collector up to the second cathode ring 20 is L, for the same time the first and the last particle of the plasma body must pass over different distances L−1 and L. In other words, their speed at the time $t_3$ must be equal to $v_p = L - 1/t_4 - t_3$ and $v_{end} = L/t_4 - t_3$ and makes the ratio of voltage at the beginning and the end of the pulse equal to $v_1 v_{end} = L - 1/L$.

It is obvious that after shortcircuiting of the voltage the forces $\bar{F}_c$, $\bar{F}_{\nabla w}$ and $\bar{F}_{\nabla jp} = 0$ and that the plasma moves by inertia and that the braking of the plasma along the guiding field will not be more than corresponding to $kT_i$ in the next mirror.

At the time $t_4$ the compressed plasma body will be connected with the first of the next set of cathode rings. Electric field is applied simultaneously and the next acceleration process starts, see FIG. 6.

The second accelerator unit must have a greater length due to the speed which has been achieved in the preceding accelerator units. After the last accelerator step the compression of the plasma body has to be at the end of the plasma accelerator in order to reach the highest $\beta$-values.

The radii $\rho_1$ and $\rho_2$, FIG. 5, must be big enough for the current density induced in the plasma during the motion in the transition part of the field to be smaller than current density in the coils of guiding field. In other words:

$$\frac{n_1 m_i v_{\parallel 1}^2}{\beta \rho_1} ; \frac{n_2 m_i v_{\parallel 2}^2}{\beta \rho_2} << jB$$

wherein $v_{\parallel 1,2}$ is the speed of plasma motion along the field in sections 1 and 2, n is the plasma density, jB is the current density in the coils, $\rho_1$ and $\rho_2$ are the radii of transition parts.

It has been taken into account that the plasma is placed near the coil. A disturbance of the magnetic field provides also the heating of the plasma by induced currents.

The plasma heating depends also on the gradient of rotational speed along the radius and compression along the axis.

The compression heating is efficient if $v_{\parallel}/C_A > 1$ where $C_A = \sqrt{B^2/4\pi\rho'}$, $\rho'$ is mass density, $\rho' = nm$. This is the condition when the fire hose instabilities occur.

Generally, plasma heating is a negative phenomena in an accelerator, because it prevents plasma compression and thus complicates the second step acceleration and also decreases the rotational speed compared with what could be reached in a cold plasma.

We claim:

1. A pulsed accelerator system for accelerating a magnetized rotating plasma, comprising magnetic means arranged symmetrically around an axis, two electrodes extending symmetrically along said axis inside said magnetic means, said electrodes being spaced form each other int he transverse direction of said axis, two pulsed power sources connected to the magnetic means and the electrodes, respectively, and openings in the inner electrode in a cross section perpendicular to said axis for the supply of a neutral gas to the space defined by said electrodes, wherein a magnetic field generated by said magnetic means is confined to form a layer which comprises a first cylindrical portion with a minor diameter, a second cylindrical portion with a major diameter, and a transition portion interconnecting said first and second cylindrical portions, said portions being arranged axis-symmetrically around said axis.

2. The system as claimed in claim 1, wherein said transition portion forms a conical layer.

3. The system as claimed in claim 1, wherein an electrical field maintained between said electrodes is applied perpendicularly to said magnetic field.

4. The system as claimed in claim 3, wherein the strength of said electrical field is controlled versus time to have an increasing value in each pulse.

5. The system as claimed in claim 1, wherein said magnetic field is repeated in space along said axis.

* * * * *

UNITED STATES PATENT AND TRADEMARK OFFICE

CERTIFICATE OF CORRECTION

PATENT NO. : 5,300,861

DATED : April 5, 1994

INVENTOR(S) : Helgesen et al

It is certified that error appears in the above-indentified patent and that said Letters Patent is hereby corrected as shown below:

ON THE TITLE PAGE:

In "[76] Inventors:" line, after "Helgesen," delete "Kuhlgränd" and insert --Kulgränd--.

In "[76] Inventors:" line, after "R. Helgesen," delete "Kuhlgranden 2, 222" and insert --Kulgränd 2, S-222--.

In "[76] Inventors:" line, after "14," delete "Himmeley" and insert --Himmelev--.

In "[76] Inventors:" line, after "4000," delete "Roskilde".

In "[76] Inventors:" line, after "Idrottsägen 8" delete "Sollentuna S-191 70," and insert --S-191 70 Sollentua--.

In "[76] Inventors:" line, after "Nepokorennych" delete "16/1-519°" and insert --16/1-519 nych--.

In "[76] Inventors:" line, after "16/1-519" delete "Leningrad 195220, U.S.S.R." and insert --St. Petersburg Russia--.

After "[22]" line, delete "Filed: Mar. 16, 1993" and insert --PCT Filed: May 2, 1989--.

After "[22]" line, insert --[86] PCT No.: PCT/SE89/00247-- and insert on following line --§ 371 Date: Jan. 2 1991-- and insert on following line --§ 102(e) Date: Jan. 2, 1991--.

In abstract, line 3, delete "arrange" and insert --arranged--.

UNITED STATES PATENT AND TRADEMARK OFFICE

CERTIFICATE OF CORRECTION

PATENT NO. : 5,300,861

DATED : April 5, 1994

INVENTOR(S) : Helgesen et al

It is certified that error appears in the above-indentified patent and that said Letters Patent is hereby corrected as shown below:

In column 2, line 17, delete "$\omega >> \upsilon_{ei}$" and insert --$\omega_i >> \gamma_{ei}$--.

In column 2, line 19, delete "$\upsilon_{ei}$" and insert --$\gamma_{ei}$--.

In column 2, line 44, delete "$\hat{\rho}z$ and $\delta Br/\delta r^{\upsilon Br}/r$" and insert -- $\hat{e}z$ and $\delta Br/\delta r^{-Br}/r$--.

In column 2, line 50, delete "$/_r \sin \alpha$" and insert --$/_r \cdot \sin \alpha$--.

In column 5, line 39, delete "$\upsilon_p = L$" and insert -- $\upsilon_e = L$ --.

In column 5, line 41, delete "$\upsilon_1 \upsilon_{end}$" and insert --$\upsilon_1 / \upsilon_{end}$ --.

In column 5, line 43, delete "$\bar{F} \nabla_{jp}$" and insert -- $\bar{F} \nabla_{je}$ --.

In column 6, line 35, delete "form" and insert --from--.

In column 6, line 36, delete "int he" and insert --in the--.

Signed and Sealed this

Twentieth Day of June, 1995

Bruce Lehman

*Attest:*

BRUCE LEHMAN

*Attesting Officer*

*Commissioner of Patents and Trademarks*